US007713075B2

(12) United States Patent
Choi et al.

(10) Patent No.: US 7,713,075 B2
(45) Date of Patent: May 11, 2010

(54) PROTRUDABLE CONNECTOR STRUCTURE FOR ELECTRONIC DEVICE

(75) Inventors: Seung-kwon Choi, Suwon-si (KR); Duck-yong Lee, Suwon-si (KR); Dok-hwan Cha, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 143 days.

(21) Appl. No.: 11/829,347

(22) Filed: Jul. 27, 2007

(65) Prior Publication Data

US 2008/0166896 A1 Jul. 10, 2008

(30) Foreign Application Priority Data

Jan. 5, 2007 (KR) ..... 10-2007-0001710

(51) Int. Cl.
*H01R 13/62* (2006.01)

(52) U.S. Cl. ..... 439/152

(58) Field of Classification Search ..... 439/43, 439/630, 159, 945, 946, 928.1, 152, 157
See application file for complete search history.

(56) References Cited

U.S. PATENT DOCUMENTS 5,889,649 A * 3/1999 Nabetani et al. ..... 361/679.38
6,231,360 B1 * 5/2001 Horie ..... 439/159
2003/0022557 A1 * 1/2003 Shimada et al. ..... 439/630

FOREIGN PATENT DOCUMENTS

KR 2005-109684 11/2005

* cited by examiner

*Primary Examiner*—Edwin A. Leon
(74) *Attorney, Agent, or Firm*—Jefferson IP Law, LLP

(57) ABSTRACT

A protrudable connector structure that includes a first frame having a first guiding hole; a second frame having a push button and a second guiding hole that overlaps with the first guiding hole when the push button is pressed; a pin inserted into the first guiding hole and the second guiding hole so that the pin moves along the first and second guiding holes; a connector member coupled to the pin; and a link that presses the pin, wherein when the pin is located in a first locking groove portion of the second guiding hole, the connector member is locked so as not to protrude outside of the housing, and when the pin is located in a second locking groove portion of the second guiding hole, the connector member is locked so as not to be inserted into the housing.

17 Claims, 4 Drawing Sheets

PROTRUDABLE CONNECTOR STRUCTURE FOR ELECTRONIC DEVICE

CROSS-REFERENCE TO RELATED APPLICATIONS

This application claims the benefit of Korean Patent Application No. 2007-1710, filed Jan. 5, 2007 in the Korean Intellectual Property Office, the disclosure of which is incorporated herein by reference.

BACKGROUND OF THE INVENTION

1. Field of the Invention

Aspects of the present invention relate to an electronic device having a connector and, more particularly, to an electronic device having a protrudable connector structure in which a connector member inserted into a housing is protruded outside of the housing when the electronic device is connected to another electronic device.

2. Related Art

Mobile electronic devices, such as mobile phones or MP3 players, include a connector to connect with other electronic devices. For example, a mobile electronic device can include a universal serial bus connecting jack (USB), which is a male connector, and a computer can include a USB slot, which is a female connector.

A male connector included in a mobile electronic device affects the external appearance of the mobile electronic device, bothers a user carrying the mobile electronic device, and can be damaged when carrying or using the mobile electronic device. Conventionally, a cap is used to cover and protect the male connector. However, due to the high possibility of losing the cap, a structure has been developed in which the male connector is inserted into a main body of the mobile electronic device; when the mobile electronic device is connected to another electronic device, the male connector is protruded outside of the main body of the mobile electronic device. In the conventional protrusion structure, the user must manually extend the male connector from the main body to the outside of the mobile electronic device by pulling an end of the connector. However, such an operation is inconvenient and troublesome.

SUMMARY OF THE INVENTION

Aspects of the present invention provide a protrudable connector structure for a mobile electronic device in which a connector is protruded outside of a main body of the mobile electronic device by pressing a button mounted on a side of the mobile electronic device.

Aspects of the present invention also provide a protrudable connector structure for a mobile electronic device in which a connector is protruded outside of the main body of the mobile electronic device by an elastic restoration force of a spring.

According to an aspect of the present invention, a protrudable connector structure is provided, comprising a housing; a first frame formed in the housing having a first guiding hole extending in a predetermined direction; a second frame having a push button protruding from a side of the housing and a second guiding hole arranged to overlap with the first guiding hole when the push button is pressed, the second guiding hole having a first locking groove portion on one end of the second guiding hole and a second locking groove portion on another end of the second guiding hole; a pin inserted into the first guiding hole and the second guiding hole so that the pin moves along the first and second guiding holes; a connector member coupled to the pin; and a link to elastically press the pin in a direction in which the connector member protrudes outside of the housing, wherein when the pin is located in the first locking groove portion, the connector member is locked so as not to protrude outside of the housing, and when the pin is located in the second locking groove portion, the connector member is locked so as not to be inserted into the housing.

According to another aspect of the present invention, the link is configured to elastically press the pin using an elastic restoration force of a torsion spring.

According to another aspect of the present invention, the link comprises a first joint connected to the first frame and a second joint connected to the first joint and the pin, and an end of the torsion spring is supported by the first frame and another end of the torsion spring is supported by the first joint.

According to another aspect of the present invention, the second frame is slidably coupled to the first frame.

According to another aspect of the present invention, the second guiding hole may comprise a V shaped lateral portion that is concavely slanted towards the center of the second guiding hole.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
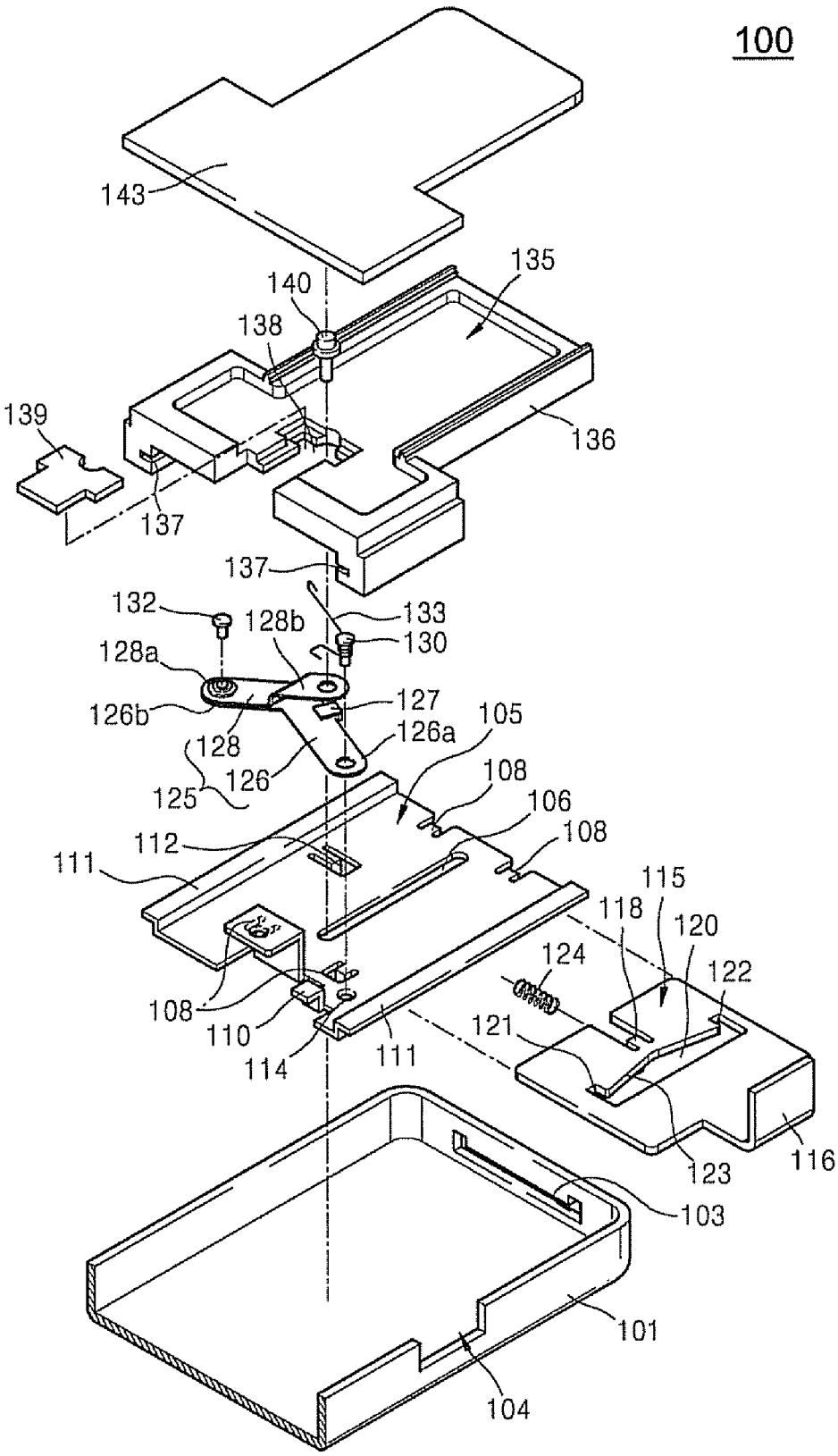
FIG. 1 is an exploded perspective view illustrating a protrudable connector structure according to an example embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

FIG. 1 is an exploded perspective view illustrating a protrudable connector structure 100 according to an example embodiment of the present invention. The protrudable connector structure 100 is included in a mobile electronic device and includes a housing comprising a base member 101 and a cover member (not shown) coupled to the base member 101, a first frame 105 mounted in the housing and is supported by a main PCB (printed circuit board) (not shown) of the mobile electronic device, a second frame 115 slidably coupled to the first frame 105, a pin 140, a link 125, and a connector member 135. The mobile electronic device may be a notebook computer, mobile phone, MP3 player, personal entertainment device, personal digital assistant, or the like.

A first through hole 103 is formed in a front face of the base member 101. A second through hole 104 is formed in a side of the base member 101. A protruding portion 136 of the connector member 135 is arranged so as to protrude through the first through hole 103, and a push button 116 included in the second frame 115 resiliently protrudes through the second through hole 104.

The first frame 105 includes a first guiding hole 106 extending in a direction parallel to the connector member 135 and a pair of guide rails 111 extending parallel to the first guiding hole 106. The pair of guide rails 111 are slidably coupled to a pair of guide slits 137 provided in a lower surface of the connector member 135. The first frame 105 also includes four (4) coupling brackets 108 that support the second frame 115 so as to allow the second frame 115 to slide with respect to the first frame 105.

The second frame 115 is coupled to the first frame 105 so that the second frame 115 can slide in a direction perpendicular to the reciprocating direction of the connector member 135 by being inserted into the four (4) coupling brackets 108. The second frame 115 is elastically biased by a compression spring 124 so that the push button 116 can protrude out of a side of the housing. One end of the compression spring 124 is supported by a first compression spring bracket 112 formed on the first frame 105. Another end of the compression spring 124 is supported by a second compression spring bracket 118 formed on the second frame 115.

The second frame 115 includes a second guiding hole 120 that overlaps the first guiding hole 106 when the push button 116 is pressed. The second guiding hole 120 includes a first locking groove portion 121 and a second locking groove portion 122, which are concavely grooved in both ends in a direction in which a compression force is applied to the push button 116. The second guiding hole 120 also includes a V-shaped lateral portion 123 that is concave in a direction in which a compression force of the push button 116 is applied.

The link 125 includes a first joint 126 connected to the first frame 105 and a second joint 128 connected to the first joint 126 and the pin 140. The first joint 126 is rotatably mounted to the first frame 105 by a first stud 130 that is inserted into a first stud inserting hole 114 formed in the first frame 105 through an end portion 126*a* of the first joint 126. The second joint 128 is rotatably mounted to the first joint 126 by a second stud 132 that is sequentially inserted into an end portion 128*a* of the second joint 128 and another end portion 126*b* of the first joint 126.

The pin 140 is sequentially inserted into a pin accommodating hole 138 of the connector member 135, another end portion 128*b* of the second joint 128, the first guiding hole 106, and the second guiding hole 120, and is fixed with respect to the connector member 135 by a pin cover 139 that covers the pin accommodating hole 138. A PCB 143 is attached to an upper part of the connector member 135 using double-sided tape or other adhesive.

The link 125 elastically presses the pin 140 using an elastic restoration force of a torsion spring 133. The first stud 130 is inserted into the torsion spring 133, an end of the torsion spring 133 is supported by a torsion spring bracket 110 formed in the first frame 105, and another end of the torsion spring 133 is supported by a torsion spring bracket 127 formed on the first joint 126. The connector member 135 connected to the pin 140 is biased in a direction in which the protruding portion 136 protrudes outside of the housing.

Figure 2A:
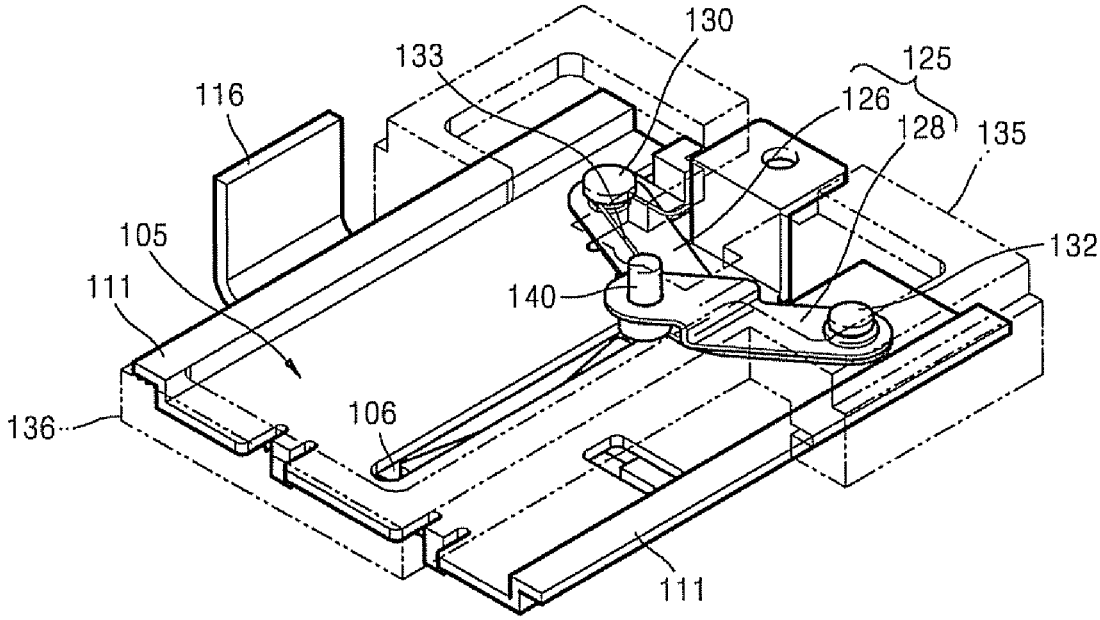
FIGS. 2A through 2C are perspective views illustrating a sequence of protruding a connector member in the protrudable connector structure of FIG. 1 from a state where the connector member is inserted into a housing.
Figure 2B:
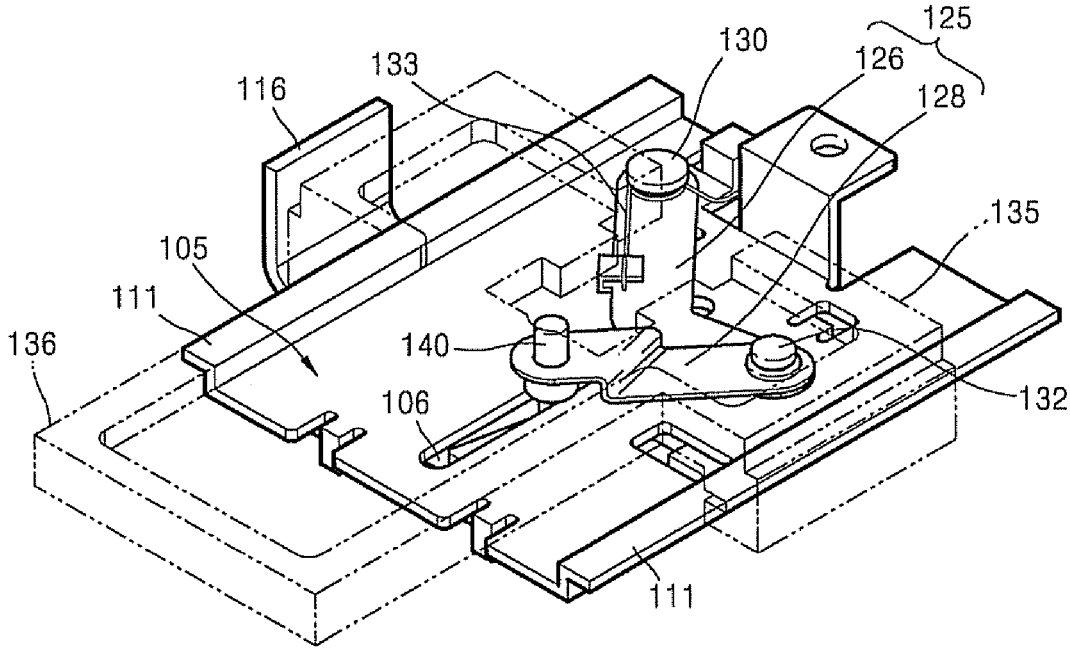
Figure 2C:
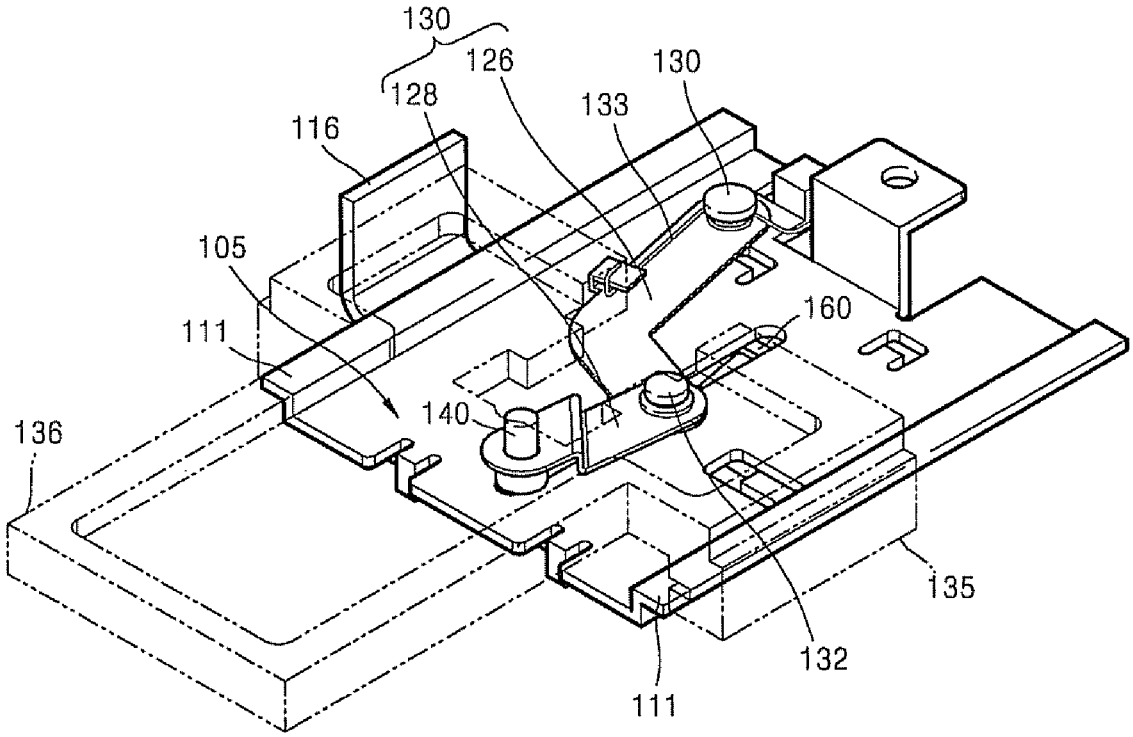
Figure 3A:
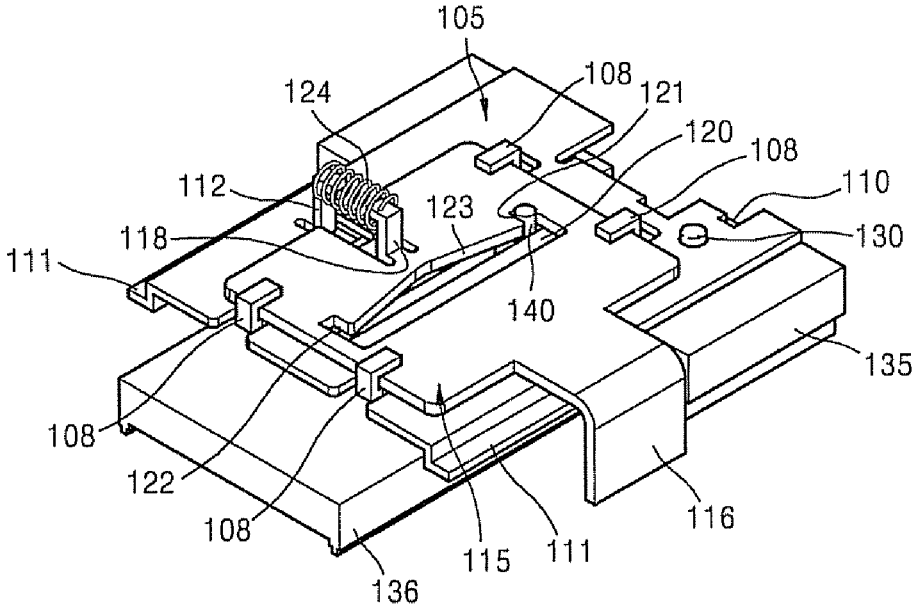
FIGS. 3A through 3C are perspective views illustrating a sequence of protruding a connector member in an overturned protrudable connector structure of FIG. 1 from a state where the connector member is inserted into a housing.
Figure 3B:
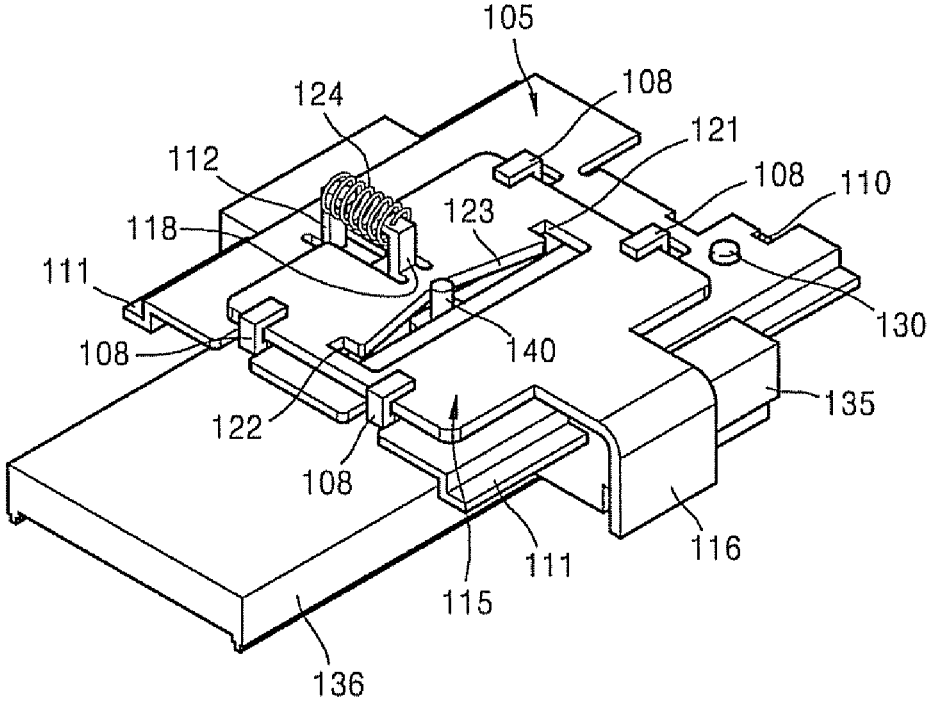
Figure 3C:
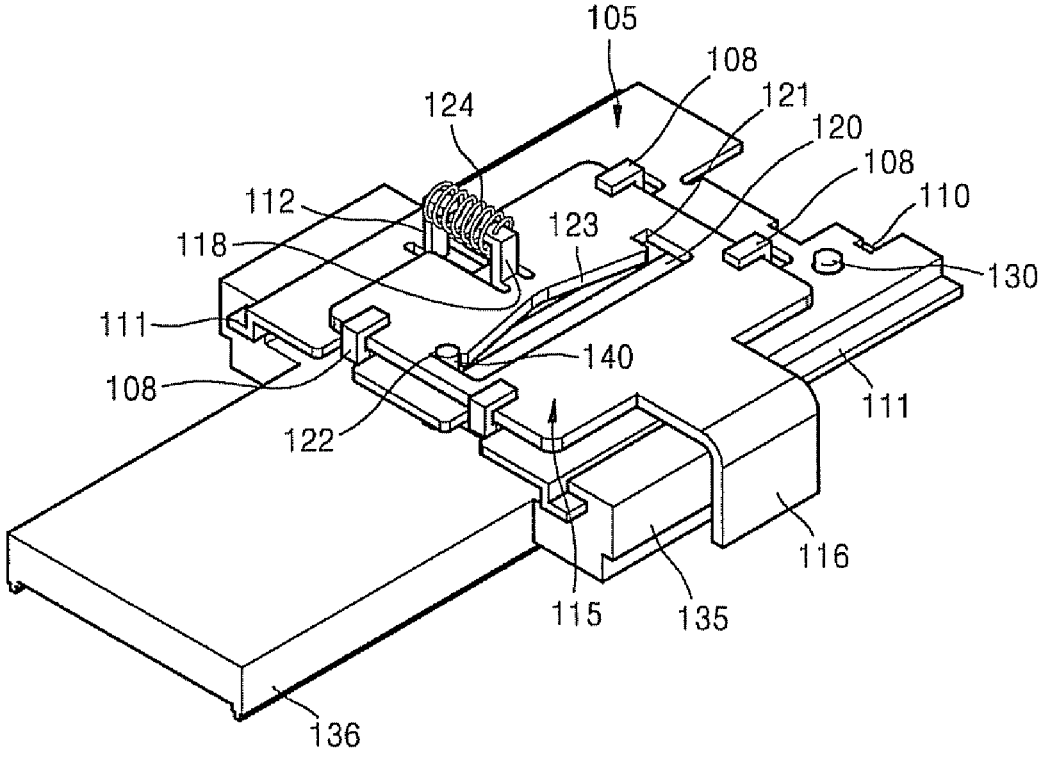

An operation of the protrudable connector structure 100 according to an example embodiment of the invention will now be described. FIGS. 2A through 2C are perspective views illustrating a sequence of protruding the connector member 135 in the protrudable connector structure 100 from a state where the connector member 135 is inserted into a housing. FIGS. 3A through 3C are perspective views illustrating a sequence of protruding the connector member 135 in an overturned protrudable connector structure 100 from the state where the connector member 135 is inserted into a housing.

Referring to FIGS. 2A and 3A, when the protruding portion 136 of the connector member 135 is inserted into the housing of a mobile electronic device in a locked state, the pin 140 is located in an inner end of the first guiding hole 106 and in the first locking groove portion 121 of the second guiding hole 120. The pin 140 is elastically biased by the torsion spring 133, but is in a locked state since the pin 140 is blocked by the first locking groove portion 121.

When the push button 116 is pressed, the first locking groove portion 121 moves, releasing the locking state of the pin 140. Accordingly, the pin 140 moves towards the outer side of the housing along the first guiding hole 106 and the V shaped lateral portion 123 of the second guiding hole 120 due to the elastic restoration force of the torsion spring 133. The protruding portion 136 of the connector member 135 begins to protrude to the outside.

Referring to FIGS. 2B and 3B, when the pin 140 moves towards a central portion of the first guiding hole 106 and the second guiding hole 120, the protruding portion 136 moves rapidly, since the V shaped lateral portion 123 is slanted in a direction that does not interrupt the motion of the pin 140 and the elastic restoration force of the torsion spring 133 is strong. However, when the pin 140 moves from a position depicted in FIGS. 2B and 3B to a position depicted in FIGS. 2C and 3C, the protruding portion 136 protrudes at a slower speed since the V shaped lateral portion 123 is slanted in a direction that interrupts the motion of the pin 140 and the elastic restoration force of the torsion spring 133 is weaker. Accordingly, the connector member 135 protrudes gently, and thus, damage to elements of the connector member 135 due to collision between the pin 140 and the first frame 105 or between the pin 140 and the second frame 115 can be prevented.

When the protruding portion 136 protrudes to a protrusion limit position, the pin 140 is located in an outer end of the first guiding hole 106 and in the second locking groove portion 122 of the second guiding hole 120. The pin 140 is locked in this position by the second locking groove portion 122. The protruding portion 136 of the connector member 135 is thus locked in a protruded state so that the protruding portion 136 cannot be inserted into the housing.

In order to re-insert the protruding portion 136 into the housing, the locking state of the pin 140 accommodated in the second locking groove portion 122 is released by pressing the push button 116 so that the protruding portion 136 can be pushed to the inner side of the housing. The pin 140 moves back along the first guiding hole 106 and the second guiding hole 120, and as depicted in FIGS. 2A and 3A, the pin 140 is seated in the first locking groove portion 121 and the connector member 135 is re-locked in an inserted state into the housing.

In the protrudable connector structure according to aspects of the present invention, a male connector can be inserted into a mobile electronic device when the male connector is not in use. Therefore, the mobile electronic device can have a pleasant appearance and is handy to carry. Damage to the male connector due to external collision can also be prevented.

In the protrudable connector structure according to additional aspects of the present invention, the male connector protrudes from a main body of the mobile electronic device by simply pressing a push button mounted in a side of the housing of the mobile electronic device. The male connector can therefore be readily used.

While there have been illustrated and described what are considered to be example embodiments of the present invention, it will be understood by those skilled in the art and as technology develops that various changes and modifications, may be made, and equivalents may be substituted for elements thereof without departing from the true scope of the present invention. Many modifications, permutations, additions and sub-combinations may be made to adapt the teachings of the present invention to a particular situation without departing from the scope thereof. For example, although the example embodiments described above are described in terms of a mobile electronic device, the protruding connector according to aspects the present invention may also be adapted to other electronic devices. Similarly, aspects of the present invention may provide a method of protruding a connector comprising pressing a button on a mobile electronic device and automatically causing the connector to protrude from the mobile electronic device in response to the pressing of the button. Accordingly, it is intended, therefore, that the present invention not be limited to the various example embodiments disclosed, but that the present invention includes all embodiments falling within the scope of the appended claims.

What is claimed is:

1. A protrudable connector structure comprising:

a housing;

a first frame formed in the housing having a first guiding hole extending in a predetermined direction;

a second frame having a push button protruding from a side of the housing and a second guiding hole arranged to overlap the first guiding hole when the push button is pressed, the second guiding hole having a first locking groove portion on one end of the second guiding hole and a second locking groove portion on another end of the second guiding hole;

a pin inserted into the first guiding hole and the second guiding hole, and movable along the first and second guiding holes;

a connector member coupled to the pin; and a link to elastically press the pin in a direction in which the connector member protrudes outside of the housing, wherein, when the pin is located in the first locking groove portion of the second guiding hole, the connector member is locked so as not to protrude outside of the housing, and when the pin is located in the second locking groove portion of the second guiding hole, the connector member is locked so as not to be inserted into the housing.

2. The protrudable connector structure of claim 1, wherein the second frame is slidably coupled to the first frame.

3. The protrudable connector structure of claim 1, wherein the second guiding hole comprises a V shaped lateral portion that is concavely slanted towards the center of the second guiding hole.

4. The protrudable connector structure of claim 1, wherein the link is configured to elastically press the pin using an elastic restoration force of a torsion spring.

5. The protrudable connector structure of claim 4, wherein:

the link comprises a first joint connected to the first frame and a second joint connected to the first joint and the pin; and an end of the torsion spring is supported by the first frame and another end of the torsion spring is supported by the first joint.

6. An electronic device comprising:

a connector fixedly coupled to the electronic device, to connect the electronic device to another device;

a pin directly coupled to the connector so as to move the pin and the connector between a first position where the connector is inside the electronic device and a second position where the connector protrudes from the electronic device; and a button arranged so as to cause the pin to move between the first position and the second position when the button is pressed.

7. The electronic device of claim 6, further comprising:

a first frame having a first guiding hole extending in a predetermined direction;

a second frame having a second guiding hole arranged so that at least a portion of the second guiding hole overlaps the first guiding hole;

wherein the pin extends through the first guiding hole and the second guiding hole.

8. The electronic device of claim 7, wherein the push button is coupled to the second frame.

9. The electronic device of claim 7, wherein the first frame is slidably coupled to the second frame.

10. The electronic device of claim 7, wherein the second guiding hole comprises a V-shaped portion having a vertex pointing in a direction perpendicular to the motion of the connector.

11. The electronic device of claim 7, wherein the first frame comprises at least one guide rail to guide the connector.

12. The electronic device of claim 7, further comprising a compression spring having one end coupled to the first frame and another end coupled to the second frame and arranged to provide an elastic force to the second frame and the button so as to cause the button to protrude from the electronic device.

13. The electronic device of claim 7, wherein the second guiding hole comprises a first locking groove on one end of the second guiding hole and a second locking groove on another end of the second guiding hole.

14. The electronic device of claim 13, wherein when the pin is in the first locking groove, the pin is locked so that the connector cannot protrude from the electronic device, and when the pin is in the second locking groove, the pin is locked so that the connector cannot be inserted into the electronic device.

15. The electronic device of claim 7, further comprising a link to elastically press the pin in the direction in which the connector protrudes from the electronic device.

16. The electronic device of claim 15, further comprising a torsion spring arranged so as to cause the link to elastically press the pin.

17. The electronic device of claim 16, wherein:

the link comprises a first joint connected to the first frame and a second joint connected to the first joint and the pin; and one end of the torsion spring is supported by the first frame and another end of the torsion spring is supported by the first joint.

* * * * *